United States Patent [19]

Wachi

[11] Patent Number: 4,520,708

[45] Date of Patent: Jun. 4, 1985

[54] TONE WAVESHAPE GENERATION DEVICE

[75] Inventor: Masatada Wachi, Hamamatsu, Japan

[73] Assignee: Nippon Gakki Seizo Kabushiki Kaisha, Hamamatsu, Japan

[21] Appl. No.: 598,380

[22] Filed: Apr. 9, 1984

[30] Foreign Application Priority Data

Apr. 11, 1983 [JP] Japan ..... 58-62360

[51] Int. Cl.[3] ..... G10H 1/02

[52] U.S. Cl. ..... 84/1.26; 84/1.01; 84/1.13

[58] Field of Search ..... 84/1.01, 1.13, 1.19, 84/1.24, 1.26

[56] References Cited

U.S. PATENT DOCUMENTS

| | | | |
|---|---|---|---|
| 4,348,929 | 9/1982 | Gallitzendorfer | 84/1.24 |
| 4,383,462 | 5/1983 | Nagai | 84/1.26 |
| 4,442,745 | 4/1984 | Gross et al. | 84/1.19 |

*Primary Examiner*—Forester W. Isen

*Attorney, Agent, or Firm*—Spensley, Horn, Jubas & Lubitz

[57] ABSTRACT

In a waveshape memory, a first waveshape of plural periods including an attack portion and a second waveshape of plural periods are stored. A tone waveshape signal is produced by reading out the first waveshape once and thereafter reading out the second waveshape repeatedly. The first waveshape is a first section including an attack portion cut off from a desired original tone waveshape. The second waveshape is principally composed of a second specified section succeeding the first specified section cut off from the original tone waveshape. A terminal portion in the second specified section is weighted with decay characteristics and is added with a corresponding terminal portion of the first specified section which has been weighted with attack characteristics, thereby effecting smooth connection between the respective waveshapes.

4 Claims, 9 Drawing Figures

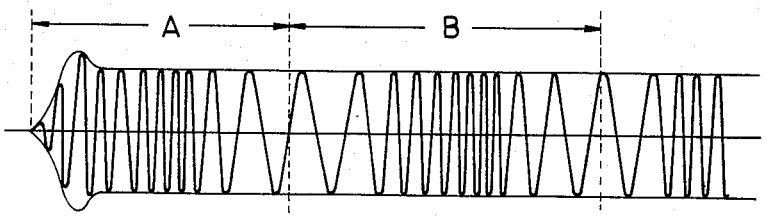
FIG. 2
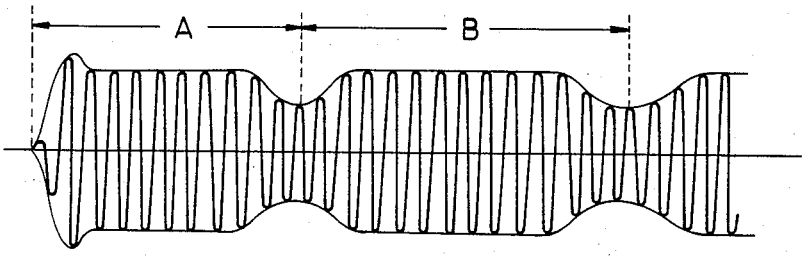
FIG. 3
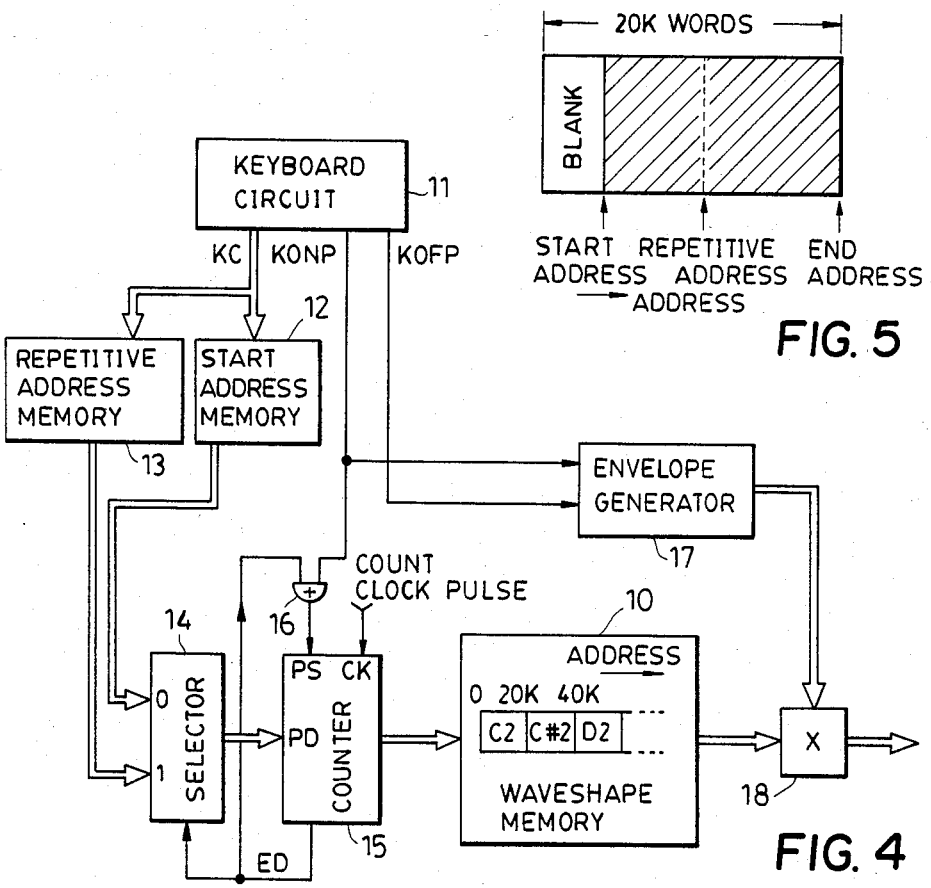
FIG. 5
FIG. 4

TONE WAVESHAPE GENERATION DEVICE

BACKGROUND OF THE INVENTION

This invention relates to a tone waveshape generation device employed in an electronic musical instrument and, more particularly, to a device capable of reading out repetitively waveshape of plural periods stored in a memory.

An electronic musical instrument of a type in which a complete waveshape from the start to the end of generation of a tone is prestored for each key (note) and this waveshape is read out is disclosed in the spedification of U.S. Pat. No. 4,383,462. In the waveshape memory WM31 shown in FIG. 3 of this United States patent, a complete waveshape is stored and this complete waveshape is read out in response to a signal KD which represents a key depression timing. This type of instrument storing all waveshapes however is disadvantageous in that it requires a memory having a large memory capacity resulting in high manufacturing cost and also that production of a sustained tone is practically impossible.

For overcoming these disadvantages, it has been proposed to store a part of waveshape of plural periods in the entire tone production period in a waveshape memory and produce a tone signal by repeatedly reading out this waveshape portion. There is a problem in this proposed system that mere continuation of the repeatedly read out waveshape portion of plural periods gives rise to unnaturalness in connecting points of repeatedly read out portions. Further, an attack portion of a tone generally changes in a complicated manner thereby exhibiting a great difference from a relatively stable waveshape in the sustain portion. For producing a tone of a good quality, therefore, a waveshape of plural periods of the attack portion should be prepared in addition to a waveshape of plural periods which is to be read out repeatedly and this attack portion should be read once before repetitive readout of the repetitive portion. Even in this case it is necessary to make an arrangement to avoid unnaturalness in the connecting point between the attack portion and the repetitive portion.

In the above U.S. Pat. No. 4,383,462, an example of such tone waveshape generation by repetitive readout is shown in FIG. 6. A complete waveshape in the attack portion is stored in the waveshape memory WM61 and at least one fundamental period of a tone waveshape is stored in the waveshape memory WM62. An attack waveshape is read out from the memory WM61 response to the key depression (KD signal) and the tone waveshape of the fundamental period is repeatedly read out from the memory WM62 after completion of the read out of the attack waveshape (IMF signal) until the end of tone generation (DF signal). In this example, however, no consideration has been given to smoothing of the connection of the end of the waveshape of the attack portion and the beginning of the waveshape of the fundamental period. Neither has any consideration been given to smoothing of the connection between the repeatedly read out fundamental periods.

SUMMARY OF THE INVENTION

It is, therefore, an object of the invention to smooth the connection between the attack portion and repetitive portion as well as the connection between the repetitive portions in a tone waveshape generation device in which a waveshape of plural periods of the attack portion is read out once and then a waveshape of plural periods of the repetitive portion is repeatedly read out.

The tone waveshape generation device according to the invention comprises a waveshape memory which stores beforehand a first waveshape of plural periods consisting of a waveshape of plural periods of an attack portion of a tone and a second waveshape of plural periods succeeding the first waveshape of plural periods and generates a tone signal by reading out the first waveshape of plural periods once and thereafter reading out the second waveshape of plural periods repeatedly. The first waveshape of plural periods to be stored in the waveshape memory consists of a first specified section including the attack portion cut off from a desired original tone waveshape. The second waveshape of plural periods consists principally of a second specified section succeeding the first specified section cut off from the original tone waveshape which second specified section has been subjected to the following processing. A predetermined width of terminal waveshape section in the cut-off second specified section is added with a corresponding width of terminal section cut off from the first specified section after weighting of both terminal sections. This weighting preferably is made such that the waveshape of the terminal section of the second specified section is decay characteristics and the waveshape of the corresponding section of the first specified section is attack characteristics.

Since the end of the first waveshape of plural periods (corresponding to the attack portion) and the beginning of the second waveshape of plural periods (corresponding to the repetitive portion) are continuous in the original tone waveshape, the connection of the attack portion and the repetitive portion of the waveshape read out from the waveshape memory can be smoothly made by the above described arrangement. Further, since the end section of the second waveshape of plural periods (repetitive portion) is weighted by the waveshape of the end section of the first specified section and the end of this first specified section (the first waveshape of plural periods, i.e., the attack portion) and the beginning of the second waveshape of plural periods (i.e., the beginning of the second specified section) are continuous in the original tone waveshape, the connection of the second waveshapes of plural periods repeatedly read out from the waveshape memory can be smoothly made.

BRIEF DESCRIPTION OF THE DRAWINGS

FIG. 1*a*–1*d* show several waveshapes to explain the basic thought of the invention.

FIG. 2 shows a variation of the original waveshape shown in FIG. 1*a* resulting from the periodical frequency modulation.

FIG. 3 shows another variation of the original waveshape shown in FIG. 1*a* resulting from the periodical amplitude modulation.

FIG. 4 is an electric block diagram showing a structure of an embodiment of the electronic musical instrument according to the invention.

FIG. 5 shows an example of how the memory zone in the waveshape memory shown in FIG. 5 is used to store a waveshape of plural periods for one key.

DETAILED DESCRIPTION OF THE PREFERRED EMBODIMENT

Figure 6:
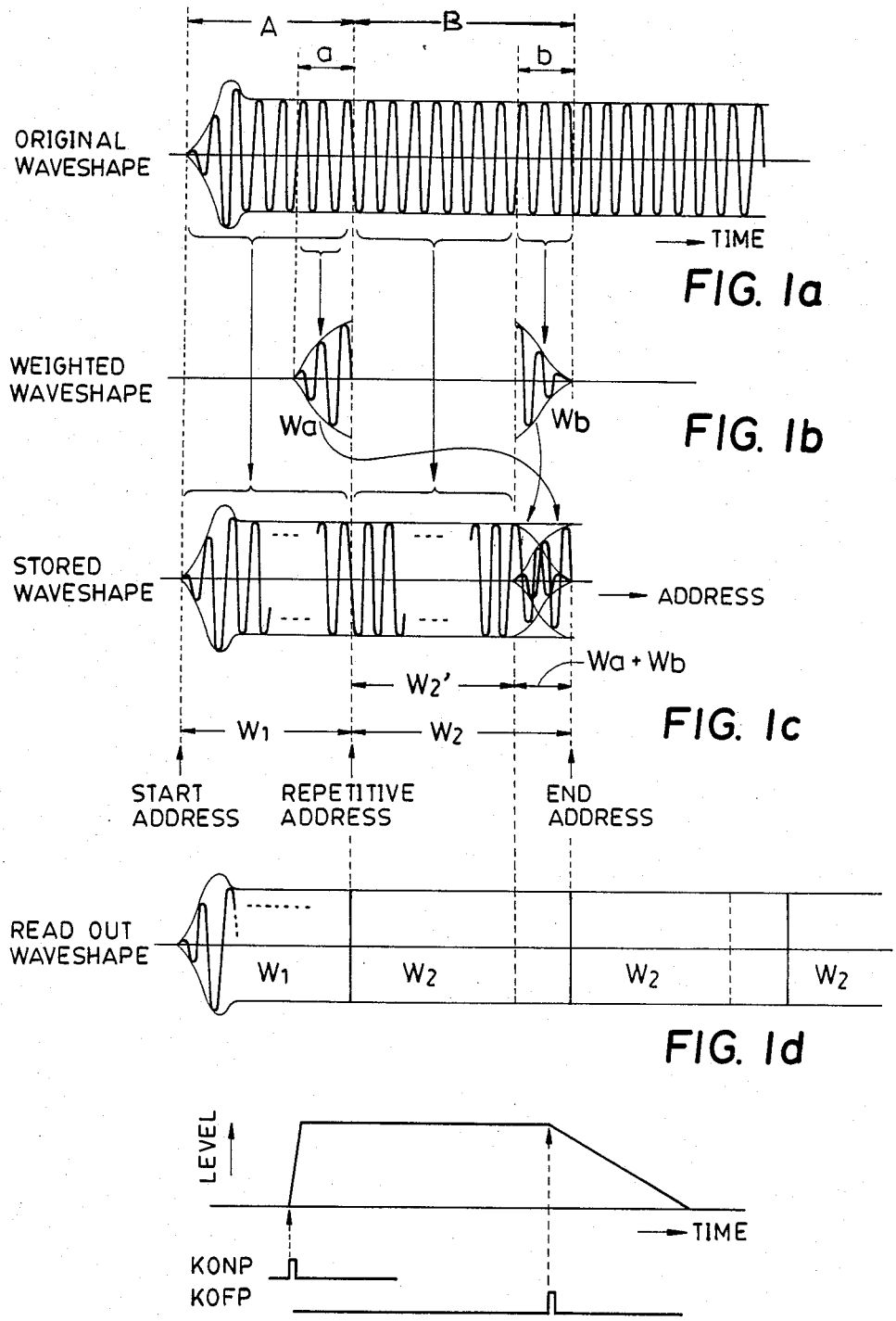
FIG. 6 shows an example of the envelope shape produced by the envelope generator shown in FIG. 4.

First, the basic thought of the invention will be described with reference to the drawings.

The tone waveshape generation device according to the invention is provided with a waveshape memory in which is stored beforehand a first waveshape of plural periods which is the waveshape of a tone to be produced from a start of production to predetermined length including a whole attack portion thereof and a second waveshape of plural periods succeeding the first waveshape. A tone signal is generated by reading out the first waveshape first once and then the second waveshape repeatedly. The first waveshape is a first specified waveshape section A including the attack portion cut off from a desired waveshape of plural periods (herein referred to as original waveshape) as shown in FIG. 1*a*. The thus cut-off first specified waveshape section A is stored in a predetermined memory zone of the waveshape memory as a first waveshape W1 of plural periods (see FIG. 1*c*). The memory zone to store the first waveshape W1 of plural periods corresponds, for instance, to the zone from the start address through immediately before the repetitive address.

The second waveshape is obtained by cutting off a second specified waveshape section B succeeding said first specified waveshape section A from an original waveshape as shown in FIG. 1*a* and subjecting the waveshape section B to a following processing. A predetermined width of terminal section b (including a waveshape of plural periods) of the cut-off second specified waveshape section B is added to a corresponding width of terminal section a cut off from the first specified section A after weighting of both terminal waveshape sections a and b. As shown in FIG. 1*b*, preferably the waveshape section a is weighted with a function of the attach characteristics (the thus weighted waveshape section a is designated by Wa) whereas the waveshape section b is weighted with a function of decay characteristics (the thus weighted waveshape section b is designated by Wb). As a result of the above processing, the second waveshape W2 of plural periods (see FIG. 1*c*) consists of a waveshape section W2′ corresponding to the second specified section B excluding the terminal section b and the waveshape Wa+Wb resulting from the addition of the respectively weighted waveshape portions Wa and Wb. Note that FIG. 1*c* shows the waveshape Wa+Wb as merely superposed on one another rather than in the form as actually added for the sake of convenience. The thus produced second waveshape W2 of plural periods is stored in a predetermined memory zone (e.g. the memory zone from the repetitive address to the end address immediately following the memory address zone for the first waveshape W1 of plural periods) of the waveshape memory.

As shown in FIG. 1*d*, the waveshape is so read out at the time of tone generation that the first waveshape W1 of plural periods (hereinafter referred to as the attack portion) is first read out once and then the second waveshape W2 of plural periods (hereinafter referred to as repetitive portion) is read out repeatedly. Since originally the attack portion W1 is followed without a break by the waveshape section W2′ corresponding to the repetitive portion W2 excluding the terminal section, the end of the attack portion W1 is connected quite naturally and smoothly with the beginning of the repetitive portion W2 as they are read out. In the terminal section (waveshape section Wa+Wb) of the repetitive portion W2, the components of the waveshape Wb dominates at the beginning (meaning a smooth connection with the preceding waveshape W2′), attenuating by degree while the components of the waveshape Wa grows more and more intensive. Since in the original waveshape the waveshape Wa is continuously followed by the beginning of the repetitive portion W2, the end of the preceding repetitive portion W2 (virtually equivalent to the end of the waveshape Wa) is connected quite naturally and smoothly with the beginning of the succeeding repetitive portion W2. Thus the read-out repetitive portions W2 is connected with one another smoothly.

The attack portion W1, the specified section B used as the repetitive portion W2, and the sections a, b forming the terminal section of the repetitive portion W2 may each be so cut off as to have any desired width. The weighting functions for obtaining the waveshapes Wa, Wb corresponding respectively to the sections a, b may also be determined as desired. In order to secure a smooth connection between the respective waveshapes, however, it is preferable to weight the waveshape Wa with the function of attack characteristics and the waveshape Wb with the function of decay characteristics. The respective widths of the sections a, b need not to equal to each other so long as they approximately correspond.

In case the original is an amplitude-modulated or frequency-modulated waveshape, the second specified section B of the original waveshape preferably is selected in the following manner. For instance, in case the original is a periodically frequency-modulated (vibrato-imparted) waveshape as shown in FIG. 2, the second specified section B is so chosen and cut off from the original waveshape as to comprise just about one repetitive period starting from a low frequency portion and ending to a next low frequency portion as shown. In case the original is a periodically amplitude-modulated waveshape as shown in FIG. 3 (e.g. waveshape as produced by the bowing of the violin), the second specified section B is so cut off as to comprise just about one amplitude cycle starting from a small amplitude portion and ending to a next small amplitude portion. In this way, the repetitive portions W2 can be connected with one another still more smoothly.

Preferred embodiments of the invention will now be described in detail referring to the drawings. FIG. 4 is an electric block diagram of an embodiment of the electronic musical instrument according to the invention. A waveshape memory 10 stores waveshapes of plural periods consisting of the attack portion W1 and repetitive portion W2 as shown in FIG. 1*c* for the respective keys (tone pitches). The waveshape memory zones for the respective keys are each specified by the start address designating the beginning of the attack portion W1 and the end address designating the end of the repetitive portion W2. In this embodiment, the waveshape memory capacity for one and every key is 20 kilo words. If the waveshape for any key were stored fully by using a given memory capacity (20 kilo words), the start address of each key would be located every 20 kilo words and the end address would be done so. In actuality, however, the cutting off of a waveshape from the original is not so made that the cut-off waveshape should occupy the entire space of the memory capacity and usually the actual memory zone of the attack portion W1 and repetitive portion W2 does not amount to a given memory capacity (20 kilo words). In that case, it is convenient to store the waveshape made up of the attack portion W1 and repetitive portion W2 so as not to leave room at the end of the 20 kilo-word memory zone, leaving a blank at the beginning instead. Thus, the end address may be adapted to locate the end of the repetitive portion W2 at the end of the 20 kilo-word memory zone for any key so that the waveshape memory zone for each key may be specified only by the start address. Besides, this is convenient in the repetitive reading-out processing.

A keyboard circuit 11 detects the depressed key of the keyboard, produces a key code KC designating the depressed key, produces a key-on pulse KONP corresponding to the beginning of the depression of the key and produces a key-off pulse KOFP corresponding to the release of the key. A start address memory 12 stores the start address corresponding to each key whereas a repetitive address memory 13 stores the repetitive address corresponding to each key. According to the key code KC supplied from the keyboard circuit 11, both memories 12, 13 read out the start address and repetitive address corresponding to the depressed key.

A selector 14 so selects one of the outputs of the memories 12, 13 according to the end address detection signal ED supplied from an address counter that normally (ED="0") it selects the output of the start address memory 12 whereas when the end address is detected (ED="1"), it selects the output of the repetitive address memory 13. The output of the selector 14 is applied to a preset data input PD of the address counter 15. The preset instruction input PS is provided through an OR gate 16 with the key-on pulse KONP from the keyboard circuit 11 and the end address detection signal ED. The counter 15 performs counting operation regularly in response to a given clock pulse and its count output is provided to the waveshape memory 10 as the address signal thereof as mentioned before it is supposed. In this embodiment, it is assumed that the value of the end address for each key is an integer multiple of the 20 kilo words. Therefore the address counter 15 is adapted to produce an overflow signal in every count 20,000 (corresponding to 20 kilo words), which signal is used as the end address detection signal ED.

An envelope generator 17 generates an envelope shape signal as shown in FIG. 6 in response to the key-on pulse KONP and key-off pulse KOFP supplied from the keyboard circuit 11. This envelope shape signal maintains a fixed level while a key is being depressed and starts attenuating upon release of the key. However the envelope shape need not necessarily be of such nature and may be of a percussive type. The envelope shape signal produced by the envelope generator 17 is applied to a multiplier 18 to impart the tone waveshape signal that was read out by the waveshape memory 10 with an envelope (particularly an envelope of decay characteristics as after the release of a key). The envelopes corresponding to the time of attack and sustain are imparted in advance to the waveshape stored in the waveshape memory 10.

Upon depression of a key, the preset instruction is given to the counter 15 by the key-on pulse KONP and the start address data that was read from the memory 12 in response to the depressed key is preset in the counter 15 through the selector 14. Thus the count starts with the start address corresponding to the depressed key and the count increases at a fixed rate so that the waveshape (including the attack portion W1 and repetitive portion W2) stored in the waveshape memory 10 and corresponding to the depressed key is read out in order, starting with the start address. When the reading out of the attack portion W1 and repetitive portion W2 is completed, the count of the counter 15 reaches the end address so that the end address detection signal ED is produced. In response to the end address detection signal ED, the selector 14 selects the repetitive address data of the depressed key that was read out from a repetitive address memory 13 whereas the counter 15 is provided with the preset instruction so that the repetitive address data is preset in the counter 15. Thus, upon completion of the reading out of the repetitive portion W2, the repetitive address data is preset in the counter 15 and the count of the counter 15 returns to the repetitive address to continue counting. Therefore the repetitive portion (the second waveshape of plural periods) W2 stored in the zone from the repetitive address to the end address may be read out repeatedly.

Although in the above embodiment, the continuous waveshape of plural periods unique to each key is stored in the memory in respect of each key (each pitch), the continuous waveshape (including the attack portion W1 and repetitive portion W2) common to all the keys or tone ranges may be stored. In that case, the count clock of the address counter is changed according to the tone pitch (or the relative tone pitch in a given tone range).

While FIG. 4 shows an example in which the present invention is applied to a monophonic electronic musical instrument, the invention of course may also be applied to a polyphonic electronic musical instrument. In the latter case, a key assigner (means for assigning a depressed key to available one among a specified number of tone generation channels) is provided in connection with the keyboard circuit 11 and the address counter 15 is adapted to operate in these channels on a time division multiplex basis so that the tone waveshape signals corresponding to the depressed keys assigned to certain channels may be read out from the waveshape memory 10 on a time division multiplex basis.

Further the invention may be applied to generation of not only scale notes as described above but also those sounds produced by the percussion instruments or other tones.

What is claimed is:

1. A tone waveshape generation device comprising:

memory means for storing, a first waveshape of plural periods which is a first specified section of an original waveshape of plural periods, said original waveshape being a complete waveshape of a tone to be produced from beginning to end of the tone production and said first specified section being a section from beginning to a certain point of said original waveshape to include an attack portion thereof, and a second waveshape of plural periods which is comprised of the concatenation of a second specified section succeeding said first specified section of said original waveshape excluding a terminal portion of said second specified section, and a terminal portion, said terminal portion being determined by adding a weighted one of a terminal portion of said first specified section and a weighted one of said terminal portion of said second specified section; and readout means for reading out said first waveshape once and thereafter reading out said second waveshape repeatedly from said memory means.

2. A tone waveshape generation device as defined in claim 1 wherein the weightings of said terminal portions are effected by weighting said terminal portion of said second specified section with a function of decay characteristics and said terminal portion of said first specified section with a function of attack characteristics.

3. A tone waveshape generation device as defined in claim 1 wherein said original tone waveshape is a waveshape provided witfh a periodical amplitude modulation and said second specified section is a section of about one period of the amplitude change with the beginning and end thereof being in the vicinity of a small amplitude portion in the periodical amplitude change.

4. A tone waveshape generation device as defined in claim 1 wherein said original tone waveshape is a waveshape provided with a periodical frequency modulation and said second specified section is a section of about one period of the frequency change with the beginning and end thereof being in the vicinity of a low frequency portion in the periodical frequency change.

* * * * *